United States Patent [19]

Killian

[11] 4,142,298

[45] Mar. 6, 1979

[54] CARRIAGE AND LATCH ASSEMBLY FOR ELEVATION ADJUSTMENT FOR ARCHERY BOW SIGHTS

[76] Inventor: Gerald I. Killian, 16016 SE. 82nd Dr., Clackamas, Oreg. 97015

[21] Appl. No.: 889,978

[22] Filed: Mar. 24, 1978

[51] Int. Cl.[2] ..... F41G 1/00

[52] U.S. Cl. ..... 33/265

[58] Field of Search ..... 33/265

[56] References Cited

U.S. PATENT DOCUMENTS

| | | | |
|---|---|---|---|
| 3,355,809 | 12/1967 | Guyton | 33/265 |
| 3,787,984 | 1/1974 | Bear et al. | 33/265 |
| 3,854,217 | 12/1974 | Killian | 33/265 |
| 3,871,105 | 3/1975 | Brougham | 33/265 |

*Primary Examiner*—Steven L. Stephan
*Attorney, Agent, or Firm*—James E. Nilles

[57] ABSTRACT

A one-piece carriage is proportioned for sliding engagement with an elongated guide which mounts an elongated micrometer screw laterally thereof and parallel thereto. An integral, lateral extension of the carriage overlies the screw and is provided with a slot perpendicular to the screw, the slot freely receiving the latch portion of a lever which is secured pivotally in the slot by a pivot pin disposed parallel to the screw. The outer portion of the lever forms a lever actuator for engagement with the screw, a spring interengaging the lever and carriage for urging the latch portion resiliently into engagement with the screw. The carriage also supports a block which mounts an archery bow sight.

4 Claims, 6 Drawing Figures

CARRIAGE AND LATCH ASSEMBLY FOR ELEVATION ADJUSTMENT FOR ARCHERY BOW SIGHTS

BACKGROUND OF THE INVENTION

This invention relates to archery bow sights, and more particularly to elevation adjustment mechanism by which to effect coarse and fine vertical adjustment of an archery bow sight relative to the bow.

An example of the prior art is my U.S. Pat. No. 3,854,217 which issued Dec. 17, 1974 and is entitled "Elevation Adjustment Mechanism for Archery Bow Sights" and is directed to a sight-mounting carriage and a separate latch mechanism which requires additional parts and is somewhat more complex and costly in construction, cumbersome to manipulate and is subject to looseness or play and becoming bent or otherwise damaged.

SUMMARY OF THE INVENTION

In its basic concept, this invention provides a carriage and latch assembly in which a one-piece carriage body mounts and confines for protection a simplified latch member of sturdy construction and easy manipulation.

It is by virtue of the foregoing basic concept that the principal objective of this invention is achieved; namely, to overcome the aforementioned disadvantages and limitations of applicant's earlier elevation adjustment mechanism.

The foregoing and other objects and advantages of this invention will appear from the following detailed description, taken in connection with the accompanying drawings of a preferred embodiment.

DESCRIPTION OF THE PREFERRED EMBODIMENT

Figure 4:
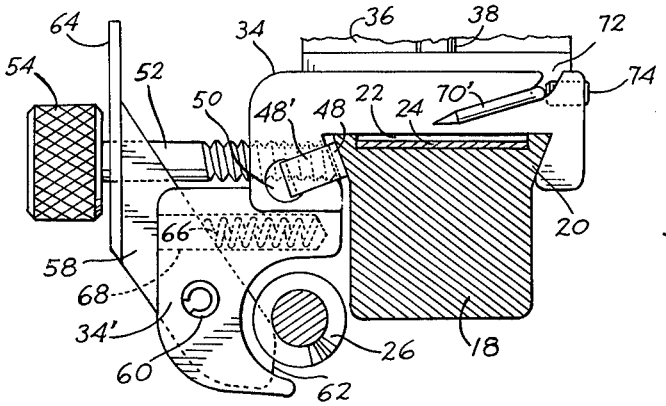
FIG. 4 is a fragmentary sectional view taken on the line 4—4 in FIG. 2.
Figure 3:
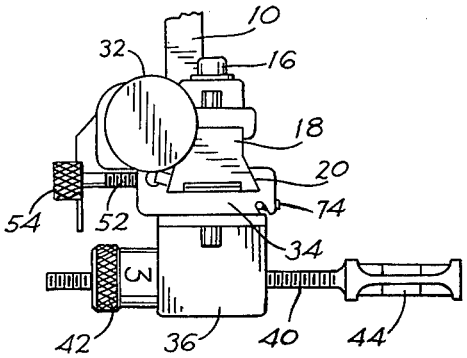
FIG. 3 is a fragmentary plan view as viewed from the top in FIG. 2.

The basic components of the elevation adjustment mechanism illustrated in the drawing are described in detail in applicant's earlier U.S. Pat. No. 3,854,217 referred to hereinbefore. It includes an elongated arm 10 adapted to be mounted on the side of an archery bow by means of a mounting plate (not shown.

Figure 1:
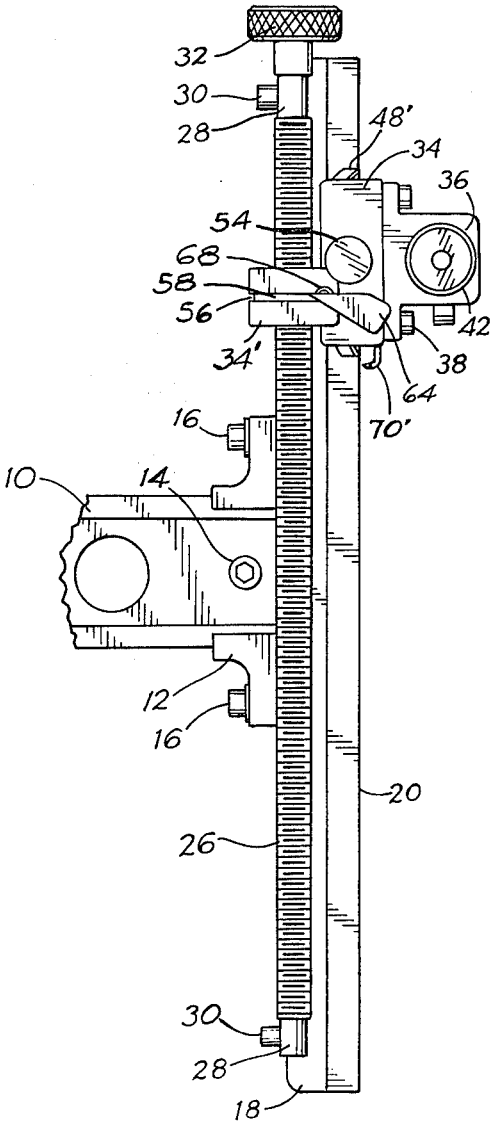
FIG. 1 is a fragmentary view in side elevation of elevation adjustment mechanism embodying the features of this invention.
Figure 2:
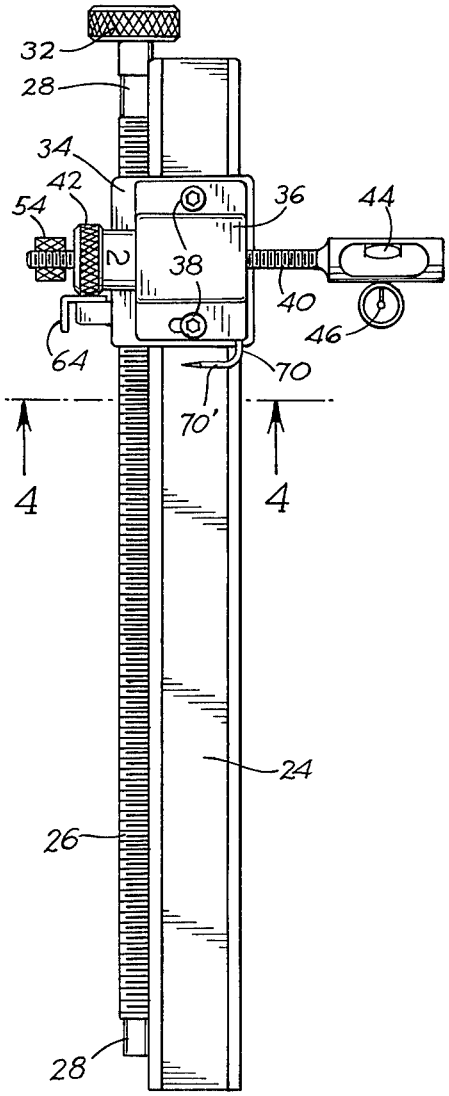
FIG. 2 is a front elevation as viewed from the right in FIG. 1.
Figure 6:
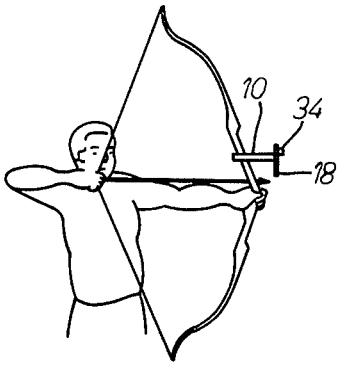
FIG. 6 is a perspective view of a bow in use and using the present invention, but shown on a reduced scale.
Figure 5:
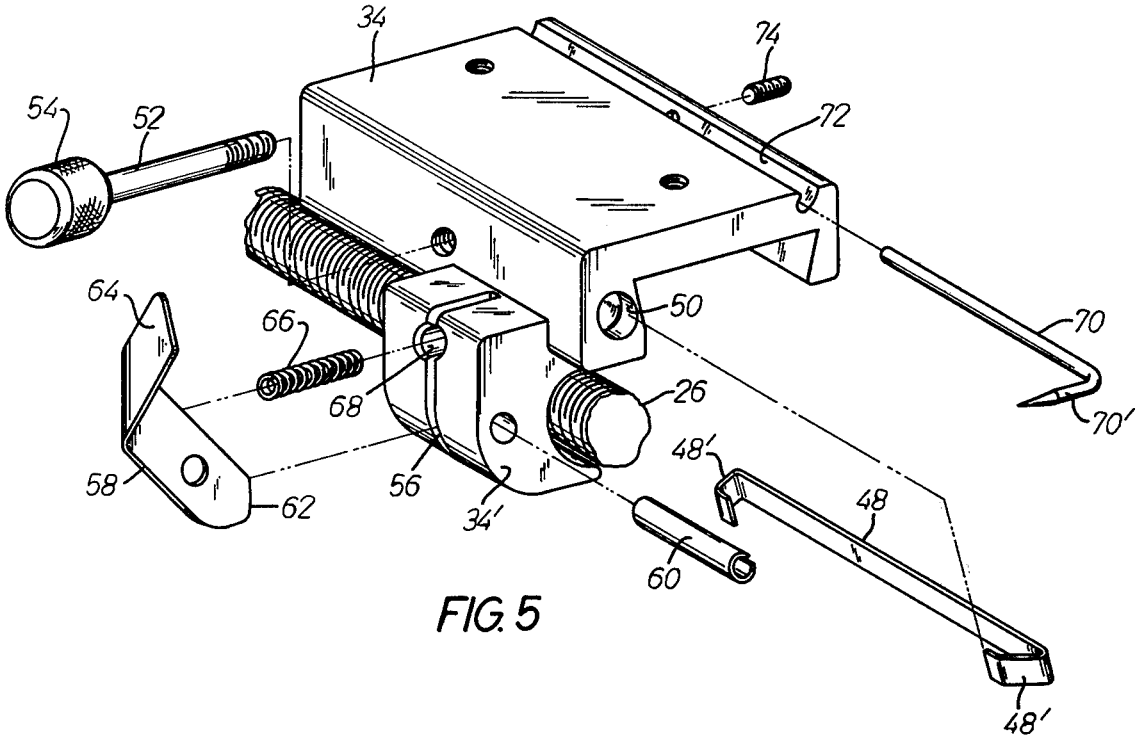
FIG. 5 is an enlarged, perspective view of the carriage and showing some associated parts in exploded view.

The forward end of the arm is connected to a bracket 12 (FIG. 1) by means of a set screw 14. The bracket includes a pair of oppositely projecting ears each of which is provided with an opening for the reception of a connecting screw 16 by which the bracket is secured to the rear side of a vertically elongated base 18.

The elongated base includes a correspondingly elongated guide 20 having a dove-tail shape in cross section. An elongated recess 22 is provided in the front surface of the guide for the removable mounting of a strip 24 (FIG. 4) of range marking paper.

An elongated micrometer screw 26 is mounted for axial rotation on the base by means of a pair of spaced bearing members 28 secured to the base by means of screws 30. One end of the micrometer screw is provided with a knurled knob 32 to facilitate its rotation. The rotational axis of the screw is disposed parallel to the longitudinal dimension of the guide 20.

The elongated guide slidably mounts a carriage 34 for a sight-supporting block 36 which is secured to the carriage by mounting screws 38. As described more fully in applicant's earlier patent identified hereinbefore, the block mounts a sight-supporting rod 40 which is adjustable longitudinally and rotationally relative to the block, by means of the adjusting knob 42, and the outer end of the rod mounts the integrated assembly of a bubble level 44 and an archery bow sight 46.

In accordance with this invention, the carriage 34 is provided in the form of a one-piece carriage body which includes an integral lateral extension 34' for the mounting of a latch by which to effect releasable coupling to the micrometer screw. The inner side of the lateral extension is contoured to provide an arcuate groove into which to receive the micrometer screw. The lateral extension thus overlaps the micrometer screw.

The carriage body is provided with a dove-tail groove matching the shape of the dove-tail guide 20. A leaf spring 48 is interposed between the guide and groove, to provide a degree of resilient frictional resistance to movement of the carriage along the guide. The ends 48' of the spring are bent back and seated in notches 50 at the opposite ends of the carriage body.

In accordance with this invention, clamp means is associated with the spring 48 for the purpose of obtaining releasable locking of the carriage body to the elongated guide. In the embodiment illustrated, this is provided by a clamp screw 52 which is received in a threaded opening in a carriage body registering at its inner end with a central portion of the leaf spring. A finger knob 54 at the outer end of the clamp screw facilitates rotation of the latter into and out of engagement with the leaf spring.

Thus, upon rotation of the clamp screw in the direction to move the screw inwardly, its upper end abuts the leaf spring and forces the latter inwardly into positive engagement with the confronting surface of the guide, thereby locking the carriage body to the guide. Upon retraction of the clamp screw, the leaf spring abuts the confronting surface of the guide resiliently, providing a degree of frictional resistance to movement of the carriage body along the guide.

Also in accordance with this invention, the integral lateral extension 34' of the carriage body functions to support a latch member for releasable engagement with the micrometer screw 26. In the embodiment illustrated, a transverse slot 56 is provided in the lateral extention, the slot being disposed substantially perpendicular to the longitudinal axis of the micrometer screw.

A lever 58 is received freely within the slot 56 and is secured pivotally therein by means of a pivot pin 60 which extends through aligned openings in the lateral extension and in an intermediate portion of the lever. The inner end portion 62 of the lever forms a latch dimensioned for retractable engagement with the micrometer screw 26. The outer end portion 64 of the lever is offset angularly relative to the straight, intermediate and inner portions thereof, to provide a finger actuator by which to rotate the lever about its pivot pin to release the latch portion from the micrometer screw.

Resilient means is provided for urging the lever rotationally into engagement of the latch portion with the micrometer screw. In the embodiment illustrated, this is provided by a coil spring 66 which is contained within a socket 68 registering with the slot 56. Thus, the coil spring is confined within the socket with its outer end abutting the inner edge of the lever, outwardly of its pivot pin.

Accordingly, the coil spring 66 urges the lever resiliently in the direction of counterclockwise rotation in FIG. 4 to bring the latch portion 62 of the lever into engagement with the micrometer screw 26. Finger pressure applied to the outer, actuator portion 64 of the lever in the direction to rotate the lever in the clockwise direction about its pivot pin, against the resistance of coil spring 66, effects retraction of the latch portion from the micrometer screw.

It will be appreciated that when the latch portion 62 of the lever is retracted from the micrometer screw 26, the carriage 34 and latch assembly, together with the supported bow sight 46, may be moved freely and rapidly along the guide 20 to any desired position of elevation. Fine adjustment to the exact position of elevation is achieved by releasing finger pressure on the actuator portion 64 of the lever, to allow the latch portion to engage the micrometer screw, and when rotating the micrometer screw by means of the knurled knob 32.

Associated with the strip 24 of range marking paper is an index pointer. In accordance with this invention, this pointer comprises an offset end portion 70' of a wire rod 70 which is laid in a groove 72 formed in the outer surface of the carriage body. As best illustrated in FIG. 4, the groove extends angularly inward, and a set screw 74 is threaded in an opening which registers with the groove, intermediate the ends thereof, to engage the rod and secure it against displacement in the groove.

It is to be observed, particularly from FIG. 4 of the drawing, that the integrated carriage body and lateral extension has a cross sectional contour that renders it suitable for production by the extrusion of metal, preferably aluminum, by ordinary extrusion techniques. After extrusion, the finished contour of the lateral extension 34' and provision of the slot 56, opening for pivot pin 60, spring socket 68, notches 50 and threaded bores for the screw 38, 52 and 74, are incorporated with the use of appropriate conventional machine tools. The cost of production of the one-piece carriage body thus is minimized while simultaneously minimizing the number of discreet parts.

It is to be noted further that the lever 58 is formed of a small piece of sheet metal and involves but a single bend to provide the offset finger actuator portion 64. The latch portion 62 of the lever is protected against damage by being confined within the slot 56 in the lateral extension of the carriage body. This confinement also provides considerable structural reinforcement for the latch portion, whereby to assist the latch portion in resisting the bending forces exerted upon it when it is in engagement with the rotating micrometer screw 26.

The foregoing features all contribute advantageously to improving the elevation adjustment mechanism of applicant's earlier patent referred to hereinbefore, by reducing the number of total parts and thus minimizing the cost of manufacture and assembly, as well as by simplifying, protecting and strengthening the latch mechanism and facilitating its manipulation.

It will be apparent to those skilled in the art that various changes may be made in the size, shape, type, number and arrangement of parts described hereinbefore, without departing from the spirit of this invention.

Having now described my invention and the manner in which it may be used, I claim:

1. In an elevation adjustment mechanism for an archery bow sight in which a base supports an elongated guide for a sight-mounting carriage and an elongated micrometer screw adjustment and parallel to the guide, the combination therewith of a carriage and latch assembly comprising:

a. a one-piece carriage body proportioned to slidably engage the guide for movement of the carriage body along the length of the guide, the carriage body being arranged to mount an archery bow sight;

b. the carriage body having an integral, lateral, latch-mounting extension arranged to overlie the micrometer screw, said lateral extension having a slot extending perpendicular to the longitudinal axis of the screw, a pivot pin mounted in said extension and across said slot, and c. a lever mounted on the lateral extension and in said slot for pivotal movement intermediate its ends on said pivot pin, said pin extending substantially parallel to the micrometer screw, d. the lever having a latch portion at one end disposed for releasable engagement with the micrometer screw and an actuator portion at the opposite end disposed for engagement by a finger for pivoting the lever in the direction to disengage the latch portion from the micrometer screw.

2. The combination of claim 1 including resilient means interengaging the lever and lateral extension for urging the latch portion toward engagement with the micrometer screw.

3. The combination of claim 2 wherein the resilient means comprises a coil spring retained in a socket in the lateral extension with one end abutting the inner edge of the lever.

4. The combination of claim 1 including a leaf spring on the carriage body engaging the elongated guide for frictionally resisting movement of the carriage along the guide, and clamp means on the carriage body engageable releasably with said leaf spring for clamping the latter against the guide for securing the carriage body releasably to the guide.

* * * * *